United States Patent [19]

Costa

[11] 4,007,961

[45] Feb. 15, 1977

[54] CONVERTIBLE SOFA-CHAIR

[76] Inventor: Tarsis Octavio Costa, Dr. Oliveira 1093, Theresopolis, R. J., Brazil

[22] Filed: Oct. 23, 1975

[21] Appl. No.: 625,066

[30] Foreign Application Priority Data

Oct. 25, 1974 Brazil .....8965

[52] U.S. Cl. ..... 297/111; 5/18 R

[51] Int. Cl.[2] ..... A47C 13/00

[58] Field of Search ..... 297/111, 105, 118, 119, 297/65, 63; 5/18 R, 12 R, 30, 28, 29, 47, 31, 37

[56] References Cited

UNITED STATES PATENTS

| | | | |
|---|---|---|---|
| 1,200,542 | 10/1916 | Thibault | 297/108 |
| 1,362,444 | 12/1920 | Spector | 297/108 X |
| 3,547,487 | 12/1970 | Shankman | 5/18 R |
| 3,867,730 | 2/1975 | Wright | 297/118 X |

*Primary Examiner*—James T. McCall
*Attorney, Agent, or Firm*—O'Brien & Marks

[57] ABSTRACT

A convertible sofa-chair is disclosed as including a pair of hollow bases operatively connected by hinged platform pieces which are foldable to permit conversion between a sitting device and a sleeping device; the two bases are spaced from each other when used as a sleeping device and are telescoped together when used as a sitting device.

7 Claims, 5 Drawing Figures

CONVERTIBLE SOFA-CHAIR

BACKGROUND OF THE INVENTION

1. Field of the Invention

The present invention relates to sofas or chairs of the type convertible into beds, sofas, or the like.

2. Description of the Prior Art

Convertible type sofas and chairs are generally well known in the prior art. The convertible devices of the prior art while satisfying the requirements for which they were designed, have met with certain drawbacks, such as complexity in construction, high costs and difficulty in operation. Attempts in correcting any of the above drawbacks have resulted in a flimsy construction which does not have sufficient strength to function as a sleeping bed even through it may function as a sitting chair, or in a construction that has sufficient strength but is too heavy for a person to fold and unfold without great difficulty.

SUMMARY OF THE INVENTION

The present invention is summarized in that a convertible sofa-chair includes a pair of generally hollow bases disposed in spaced relation to each other, a platform overlying both of the bases to define a sleeping bed, one of the bases being smaller than the other permitting a telescoping arrangement whereby the sleeping bed may be converted into a sitting chair, and hinge means pivoting parts of the platform into a back rest for the sitting chair when the bases are telescoped together.

An object of the present invention is to construct a convertible sofa-chair in a simple, economical arrangement.

This invention has another object in that a convertible sofa-chair is constructed without any complex mechanism and without hardware except for two folding hinges.

DESCRIPTION OF THE PREFERRED EMBODIMENT

While the above drawings and the following description are directed to the specific details of a chair convertible into a single sleeping bed, it should also be noted that such specific details are likewise applicable to a sofa convertible into a double sleeping bed. Furthermore, a pair (or any practical multiple) of single sleeping beds of FIG. 4 may be placed side-by-side and connected by any suitable fasteners into a double (or larger) sleeping bed. Even when joined as a double sleeping bed, the simplicity of the construction permits conversion to a sitting sofa without separation of the fasteners because very little force or strength is needed to cause such conversion.

Figure 1:
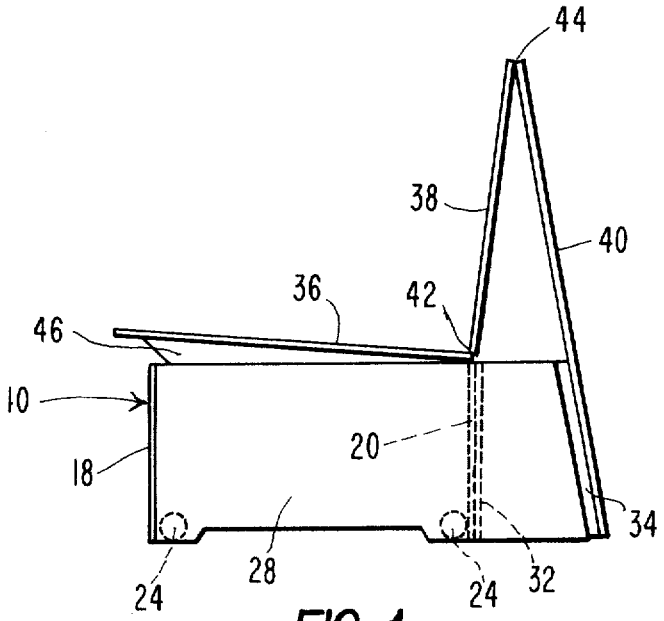
FIG. 1 is a side elevation view of a convertible chair embodying the present invention.

As is illustrated in FIGS. 1–4, the present invention is embodied in a convertible sofa or chair, indicated generally at 10 in FIG. 1, which includes a movable hollow base and a fixed hollow base operatively interconnected by a platform. The movable base 12 has a pair of side walls 14 and 16, front and rear walls 18 and 20 and a bottom wall 22 all joined together to form a generally hollow container or storage box which is open at its top. Horizontal movement of the movable base 12 is facilitated by any suitable anti-friction means, such a plurality of rollers 24 attached to the four corners of the base 12.

Figure 2:
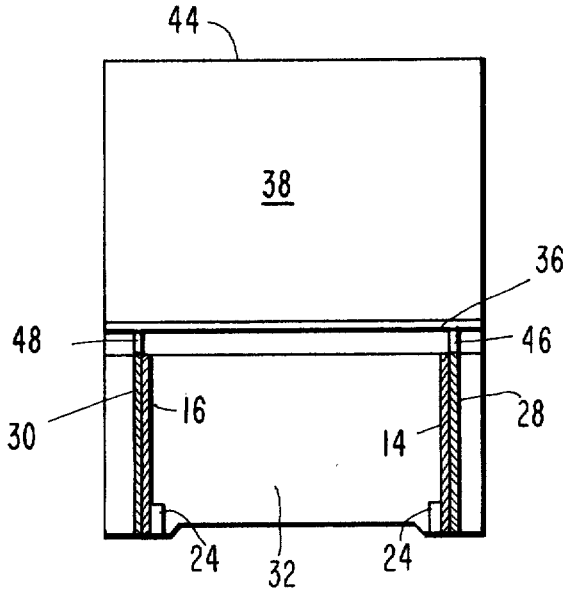
FIG. 2 is a front elevation view of FIG. 1 looking from the left of FIG. 1.

The generally fixed base 26 includes a pair of side members 28 and 30 joined by an intermediate member 32 and a slanted rear member 24 which is wider than the intermediate member 32. The two side members 28 and 30 are spaced from each other a distance slightly greater than the outside dimension between the two side walls 14 and 16 of the movable base 12. The fixed base 26 is open at its front end and at its top and bottom, which arrangement permits the movable base 12 to nest or telescope into the hollow base 26 as is shown in FIGS. 1 and 2.

Figure 3:
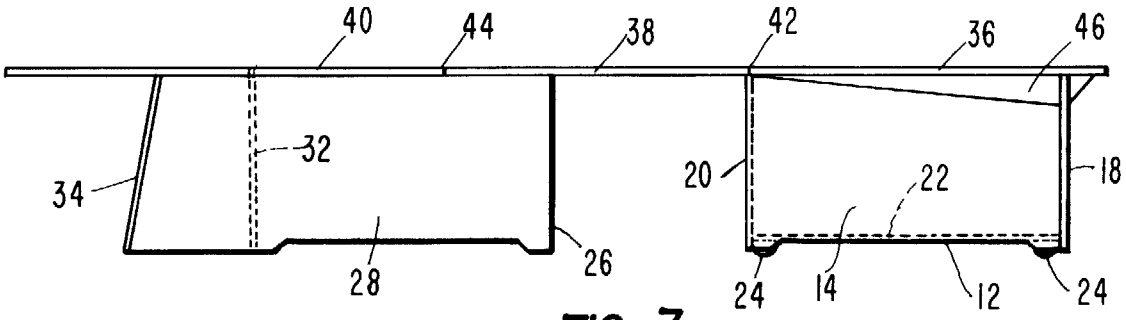
FIG. 3 is a side elevation view of the chair of FIG. 1 after being converted to a sleeping bed.
Figure 4:
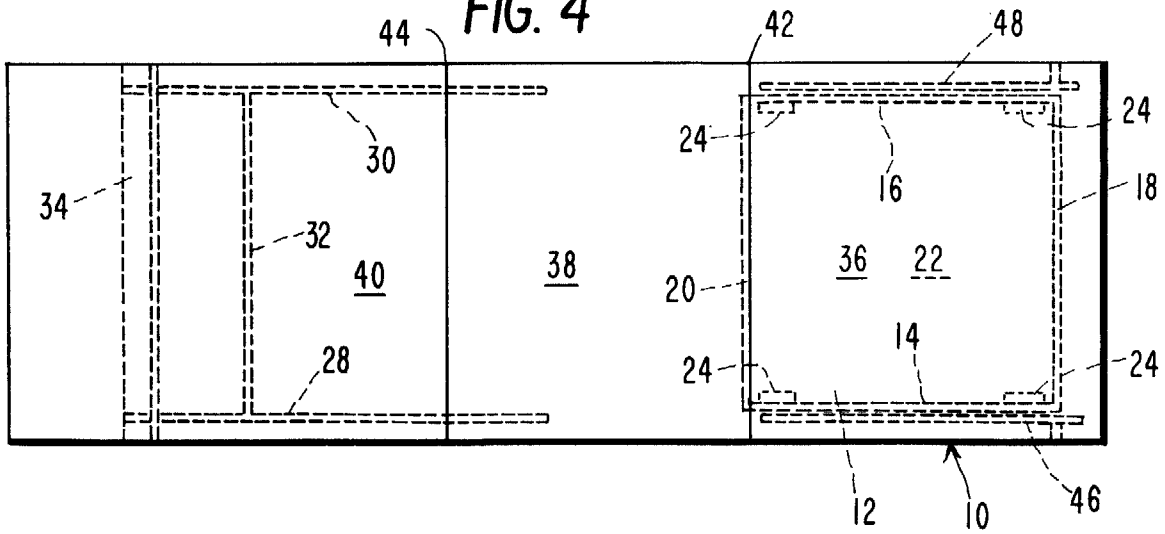
FIG. 4 is a top plan view of FIG. 4.
Figure 3A:
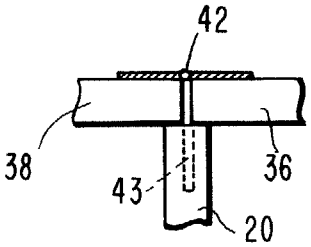
FIG. 3*a* is an enlarged fragmentary view of a detail of FIG. 3.

As is shown in FIGS. 3 and 4, the two bases 12 and 26 are of equal height to define a support for a generally flat platform which includes a first front piece 36, a second intermediate piece 38 and a third rear piece 40. The three parts 36, 38 and 40 present a substantially flat surface which slightly overhangs the sides and ends of the spaced bases 12 and 26; this flat surface receives a mattress or section cushions which are not shown but which may be stored in the storage box of movable base 12. A first hinge 42 joins the first and second platform pieces 36 and 38 while a second hinge 44 joins the second and third platform pieces 38 and 40. The hinges 42 and 44 may be of any suitable construction, such as invisible hinges, so long as their pivotal axis are in horizontal planes parallel to the planes defining the axis of the rollers 24. As is shown in FIG. 3*a* the hinge 42 includes a pair of vertical bolts or fasteners 43 spaced from each other and driven into the top edge of the rear wall 20.

As is best shown in FIGS. 1 and 3, a pair of slanted elements 46 and 48 are fixed to or integrally formed with the undersurface of platform piece 36; when in a extended or sleeping bed condition (FIGS. 3 and 4), the slanted elements 46 and 48 are not in contact with the fixed base 26 and are outside of the movable base side wall 14 and 16; when in a folded or sitting chair condition (FIGS. 1 and 2) the slanted elements 46 and 48 are in contact throughout their lengths with the top edges of side members 28 and 30, respectively, inclining the first platform 36 and keeping the base 12 in position.

Assuming now that the unfolded condition (FIGS. 3 and 4) of the convertible device is to be changed to its folded condition, the second platform 38 is tilted slightly upward so that it is rotated clockwise about the pivot axis 44 as viewed in FIG. 3. The front of the movable base 12 is now pushed rearwardly causing the second and third platforms pieces 38 and 40 to form an inverted V-shaped back-rest (FIG. 1) with the lowermost portion of the third platform piece resting against the slanted rear member 34 of the fixed base 26. At the same time the slanted elements 46 and 48 engage the top edges of side members 28 and 30, respectively, causing the first platform piece 36 to pivot counterclockwise about the pivot axis 42 as viewed in FIG. 1 whereby the first platform piece 36 forms a slanted seat for the sitting chair.

With the above arrangement, the present invention has a particular advantage in that folding and unfolding of the convertible device may be accomplished without the use of great strength or a skilled operator. The rearward pushing of the movable base is facilitated by the anti-friction rollers so it is easily telescoped into the fixed base with the pivoting of the platform pieces be accomplished automatically.

Inasmuch as the present invention is subject to many variations, modifications and changes in detail, it is intended that all matter contained in the foregoing description or shown on the accompanying drawings shall be interpreted as illustrative and not in a limiting sense.

What is claimed is:

1. In a convertible sofa, chair or the like, the combination comprising a pair of generally hollow bases disposed in spaced relation to each other, platform means overlying both of said bases to define a sleeping bed, one of said bases being smaller than the other of said bases permitting a telescoping arrangement therebetween whereby the sleeping bed may be converted into a sitting chair, hinge means pivoting parts of said platform means into a back rest for the sitting chair when the bases are telescoped together, and spaced slanted elements carried by one part of said platform means and straddling the smaller one of said bases when the bases are extended from each other, said spaced slanted elements engaging the other of said bases when the bases are telescoped together so that the one part of said platform means defines a slanted seating surface.

2. The invention as recited in claim 1 wherein the pivoted parts of said platform means are disposed in an inverted V-shaped configuration.

3. The invention as recited in claim 1 wherein said platform means includes three parts interconnected by said hinge means.

4. The invention as recited in claim 3 wherein said hinge means comprises a pair of hinges, one of which is connected to said one of said bases.

5. The invention as recited in claim 4 wherein said back rest is formed by two parts of said platform means with the other of said hinges therebetween.

6. In a convertible sofa, chair or the like, the combination comprising a generally fixed base having a pair of spaced side members and a rear member joining rear end portions of said side members, a generally movable base having a pair of spaced side walls, a rear wall joining rear end portions of said side walls, a front wall joining front end portions of said side walls, a bottom wall extending between said side, front and rear walls to form a storage box, and roller means on said base to facilitate movement thereof, a three piece flat platform supported on top of said fixed and movable bases, a first hinge connecting first and second pieces of said platform and a second hinge connecting second and third pieces of said platform, said first hinge also being connected to said rear wall of the movable base whereby movement of said movable base against said fixed base causes said second piece to pivot relative to said first and third pieces, said side members of said fixed base being spaced a greater distance that said side walls of said movable base whereby said movable base may nest in said fixed base, and spaced slanted elements formed on the undersurface of said first piece of said platform and being in contact with top edges of said spaced side members of the fixed base whereby said first piece presents a slanted seating surface and whereby the assembly is frictionally locked in its sitting chair condition.

7. The invention as recited in claim 6 wherein the three pieces of said platform are of equal thickness, and wherein the fixed and movable bases are of equal heights.

* * * * *